US006540029B2

(12) United States Patent
Snoeys et al.

(10) Patent No.: US 6,540,029 B2
(45) Date of Patent: Apr. 1, 2003

(54) DEFLAGRATION AND EXPLOSION SUPPRESSION AND ISOLATION APPARATUS FOR CONTAINED HAZARDOUS MATERIAL

(75) Inventors: Jef Snoeys, Rijkevorsel (BE); Marc Van den Schoor, Antwerpen-Ekeren (BE); Sven J. R. De Vries, St. Job (BE); John E. Going, Kansas City, MO (US)

(73) Assignee: Fike Corporation, Blue Springs, MO (US)

( * ) Notice: Subject to any disclaimer, the term of this patent is extended or adjusted under 35 U.S.C. 154(b) by 0 days.

(21) Appl. No.: 09/791,401

(22) Filed: Feb. 23, 2001

(65) Prior Publication Data

US 2002/0117312 A1 Aug. 29, 2002

(51) Int. Cl.[7] ..... A62C 2/00; A62C 3/00; A62C 8/00

(52) U.S. Cl. ..... 169/46; 169/45; 169/47; 169/48; 169/49

(58) Field of Search ..... 169/46, 45, 47, 169/49, 48, 60; 239/67, 271, 272, 309

(56) References Cited

U.S. PATENT DOCUMENTS

| | | | | |
|---|---|---|---|---|
| 3,358,961 | A | 12/1967 | Montgomery et al. | |
| 3,373,758 | A | 3/1968 | Boutwell et al. | |
| 3,720,620 | A | 3/1973 | Taber | |
| 3,739,796 | A | 6/1973 | Jabiansky | |
| 4,108,195 | A | 8/1978 | Berry | |
| 4,169,508 | A | * 10/1979 | Jauros et al. | 169/47 |
| 4,215,749 | A | 8/1980 | Dare et al. | |
| 4,290,578 | A | 9/1981 | Earp et al. | |
| 4,391,017 | A | * 7/1983 | Bruensicke | 15/313 |
| 4,453,286 | A | * 6/1984 | Wieland | 15/313 |
| 4,552,325 | A | * 11/1985 | Bruensicke | 244/118.5 |
| 4,794,890 | A | 1/1989 | Richeson, Jr. | |
| 5,362,028 | A | 11/1994 | Jacobs | |
| 5,853,018 | A | 12/1998 | Deland et al. | |

OTHER PUBLICATIONS

Fike Corporation Drawing No. A6610–I entitled Gate Valve Assy. Dated Jan. 1991.

Fike Corporation's Process Safety Progress—Pipe and Duct Deflagrations Associated with Incinerators—Reprint from the Winter 1996 issue.

* cited by examiner

*Primary Examiner*—Michael Mar
*Assistant Examiner*—Davis Hwu
(74) *Attorney, Agent, or Firm*—Hovey Williams LLP

(57) ABSTRACT

Deflagration suppression and explosion isolation system (10) is provided for contained hazardous material. Containment structure (12) for a highly flammable, particulate or gaseous material is connected by a conduit (16) to an area (14) for collection or processing of the material. Normally, the particulate gaseous material is conveyed via the conduit (16) to the collection or processing area (14). However, the conduit is of a length and configuration such that upon unforeseen ignition of the material in the containment structure (12), flame and combustion generated pressure resulting from the incipient explosion in the containment structure can course along the conduit (16) connected thereto toward the collection or processing area (14) in the form of a deflagration front that transitions into a detonation stage before reaching the collection or processing area unless adequately suppressed and isolated. A pressure detector (18) is connected to the containment structure (12) for detecting a rapid rise of pressure in the containment structure indicative of an incipient explosion. A suppressant device (20, 22) communicates with the conduit (16) in disposition to direct a fire suppression agent into the conduit to prevent the flame and combustion generated pressures from the incipient explosion in the containment structure from transitioning from a deflagration stage to a detonation stage in the conduit. A gate valve assembly (24) is provided in the conduit downstream of the suppressant device (20, 22) which has a gate member (70) which is closed in tandem with release of the suppressant agent into the conduit to isolate the flame and combustion generated pressures and thereby prevent the flame and combustion generated pressures from entering the collection or processing area (14).

11 Claims, 2 Drawing Sheets

10
24
PROTECTED AREA
14
2.
2.
20
16
12
CONTAINMENT PROCESS VESSEL
(COMBUSTION AREA)
18

5.
5.

DEFLAGRATION AND EXPLOSION SUPPRESSION AND ISOLATION APPARATUS FOR CONTAINED HAZARDOUS MATERIAL

FIELD OF THE INVENTION

This invention relates to explosion suppression and isolation apparatus for use with structure which confines highly combustible, flowable material and that is normally conveyed to or from a collection or processing area remote from the structure through an interconnecting conduit. The combustible material presents a hazard in that flame and combustion generated pressures resulting from an unforseen ignition and explosion of the material will rapidly and often destructively be directed into the processing or collection area.

The apparatus hereof is operable to prevent the propagating flame front from an explosion transitioning from a deflagration state to a detonation state, and to then isolate and prevent the suppressed flame and deflagration pressures from entering the collection or processing area through the conduit.

DESCRIPTION OF THE PRIOR ART

Many industrial processes involve handling of highly combustible and therefore very hazardous materials, which are normally confined within containment structure, but are then directed through an interconnecting conduit to another processing or collection area. Exemplary in this respect are machining operations on aluminum and magnesium products which produce very small metal fines. The machining operation often is carried out within structure which confines the metal particles, or the resulting fines can be directed into a vessel for storage until the material is delivered through a conduit or the like to a desired collection point or processing area. Similarly, extremely hazardous, flammable fluids or gases are received or stored in a confinement vessel which is also connected to a processing or collection area by a conduit.

The collection or processing area which receives the hazardous metal fines, other types of solid, very small combustible particles, or combustible gaseous or fluid materials is usually spaced some distance from the initial storage or confinement vessel. A conduit is most often used to convey the hazardous flowable material from the containment or storage structure or vessel to the point where it is either collected or further processed.

If the highly combustible material in the containment structure or storage vessel ignites as a result of an unforseen event, the propagating flame front resulting from the ignition rapidly transitions from an initial deflagration state to a detonation state within the conduit. Undesirable flame and often destructive pressures may therefore be delivered directly into the collection or processing area through the conduit which connects the containment structure or storage vessel with the collection or processing area.

Typically, in view of the volume of highly flammable, flowable materials that must be appropriately contained and then directed via a conduit to a collection or processing area remote from the point of collection or containment, the delivery conduits are of relatively large diameter, e.g., 12 to 24 in. Furthermore, the conveyance structure which for example may comprise of a delivery conduit often includes bends or other obstacles which induce turbulence that substantially contribute to the acceleration of flame propagation. Ignition of combustible material may occur in the confinement structure which also substantially contributes to acceleration of flame propagation by a rapid injection of flame into the interconnecting conduit or pipe. In view of the violent nature of explosions that may occur from containment, storage and conveyance of highly flammable materials as described, as well as others having similar hazardous characteristics, there has been no reliable way to prevent flame transition to detonation and isolation of the combustion flame and pressure from the explosion so that the flame and pressure wave do not enter the defined collection or processing area.

It has been proposed to protect a processing or collection area which normally receives the highly flammable material from the containment structure or storage vessel, by providing equipment for directing a suppressant agent into the material-conveying conduit downstream of the containment structure or vessel. A detector in that proposal is located to sense ignition of the combustible material ahead of the location where a suppressant agent is delivered into the conduit. In the case of deflagrations of highly flammable materials originating in the containment area adequate suppressant agent cannot be effectively delivered to a large diameter delivery conduit at the necessary rate and for a duration to prevent transition of the deflagration to a detonation state. Likewise, it has not heretofore been feasible to mechanically block entry of flame and combustion generated pressure produced by an explosion of highly combustible material from entering the collection or processing area to be protected when the deflagration has transitioned to detonation velocities. Conversely, it is not possible to place a mechanical isolation device at a location ahead of the distance where a deflagration can transition to a detonation and still provide sufficient time to effect closing of the valve.

In order for an explosion to occur, a fuel and oxidizer mixture within the flammable limits of the fuel must be exposed to an ignition source of adequate strength to initiate combustion. If the flammable material is contained in a structure or is in an elongated pipe or conduit, immediately upon ignition, an explosion will propagate from the ignition point into the unburned fuel and oxidizer mixture. A spherical flame front is first formed which continues to grow until the confining walls are reached. A pressure wave is also generated, which travels at the speed of sound of the mixture it is propagating into. At this point in time, the flame front and the pressure wave are traveling at different speeds, with the pressure wave traveling much faster than the flame front.

Once the flame front has reached the wall of the pipe or conduit, it changes from spherical form to an essentially planar front. As the planar flame front continues to propagate down the length of the pipe, it begins to elongate and the surface of the flame increases. As the surface area increases, the burning rate increases and as a result, the flame propagation velocity increases. This stage of an incipient explosion initially involves a phenomena known as "deflagration," which may be defined as conditions where the pressure wave and flame front are traveling separately, the pressure wave is traveling at the speed of sound, and flame front propagation involves heat transfer.

The pressure wave and the flame front eventually coalesce into a shock wave. If propagation continues, the energy of the pressure wave is sufficient to cause localized explosions. At the point where the pressure wave is strong enough to initiate the combustion reaction, the explosion phenomena becomes known as "detonation." In the initial stages, the detonation wave will propagate into a precompressed mixture of fuel and oxidizer, known as "over-driven detonations." The over-driven detonation will catch up to the foremost pressure wave and become a stable detonation with a constant velocity. A stable detonation wave consists of a pressure wave closely coupled with a flame front such that the energy released by the flame front supports the pressure wave.

Therefore, in a typical explosion in a conduit, the deflagration stage may be followed immediately by detonation. At each stage of an explosion, magnitude of pressure, rate of pressure rise, flame velocity and relative location of flame front to the pressure front, are different, depending upon the material that is susceptible to exploding, the point of ignition, and the nature of the conduit along which the flame is propagating.

In the deflagration region of an incipient explosion, pressures experienced increase from 0 bar g up to no more than about 10 to 12 bar g. In the detonation region, pressures can varying from about 20 up to as much as 80 bar g. Flame velocity in the deflagration region is usually of the order of 100 to 300 m/s, while flame velocity in the detonation region typically will rise to a level of about 1500 to 2500 m/s.

The size of the particles of the combustible flowable material has an effect on the overall explosion phenomena, as does the diameter of the conduit through which the products of combustion are flowing. Pipes of larger diameter provide smaller heat sinks than smaller diameter pipes or conduits. The longitudinal configuration of the conduit also affects the propagation phenomena. Obstacles and bends in the pipe or conduit can exert turbulence which in turn will effect flame surface area and cause faster transition to detonation. Where ignition occurs in a closed vessel or containment structure, it is known as "prevolume" ignition. This leads to initially higher flame propagation speed, faster transition to detonation, and higher pressure generation.

The goal of explosion protection is to suppress the deflagration stage of the explosion, preventing the deflagration phenomena from transitioning into detonation phenomena, and block the flame and combustion generated pressures from entering a protected area at the end of the conduit or pipe opposite the containment structure or storage vessel that normally receives the hazardous material. In the case of highly flammable and hazardous flowable materials such as aluminum and magnesium particles, other similar metal fines, or gases such as hydrogen, this goal has not heretofore been realized.

SUMMARY OF THE INVENTION

The present invention provides deflagration suppression and explosion isolation apparatus for preventing flame and combustion generated pressures resulting from explosion of a highly flammable, flowable material in a containment structure or a storage vessel from entering a collection or processing area that normally receives the material or is the sources of the material via a conduit interconnecting the structure or vessel and the collection or processing area.

The overall deflagration suppression and explosion isolation system includes containment structure, which may for example comprise a storage vessel or compartment, for confining a flowable, highly combustible material which presents a fire and explosion hazard, such as aluminum or magnesium dust, certain highly flammable organic materials, and gases such as hydrogen. An elongated conduit connected to the structure normally conveys flowable material to or from the structure to a collection or processing area remote from the containment structure. The conduit is typically of a length and configuration longitudinally thereof that upon unforseen ignition of the material in the structure, flame can course along the conduit in the form of a deflagration front that transitions into a detonation state before reaching the material collection or processing area.

A suppressant device communicating with the conduit is in disposition to direct a fire suppressant agent into the conduit. A detector associated with the structure and conduit is operable to sense ignition of the material in the structure and to activate the suppressant device to deliver suppressant agent into the conduit. The suppressant unit is located on the conduit along the length thereof in disposition to begin introducing suppressant agent into the conduit before the flame has reached its location.

An isolation assembly connected to the conduit ahead of the collection and processing area and after the suppressant unit is operable in association with the suppressant device to ;prevent flame and combustion generated pressure from entering the collection or processing area via the conduit. Isolation of the collection or processing area is preferably accomplished through provision of a gate valve connected to the conduit downstream of the suppression agent delivery device which has a valve plate normally in unblocking relationship to the conduit, but that can rapidly move into a position fully blocking the conduit upon detection of an incipient explosion by the ignition detector. In a preferred form of the invention, the suppressant device includes a vessel for storing a quantity of a powder suppressant under gas pressure, a rupture disc normally preventing release of suppressant from the suppressant vessel, and a gas cartridge unit operable to produce a gaseous discharge sufficient to rapidly rupture the disc upon receipt of an activation signal from the incipient explosion detector. In that same preferred form of the invention, the gate valve also is provided with a gas cartridge unit which is operable to produce a gaseous discharge which effects rapid closing of the gate of the gate valve when the incipient explosion detector detects ignition of the highly flammable material in the containment structure.

DETAILED DESCRIPTION OF THE PREFERRED EMBODIMENTS

Figure 1:
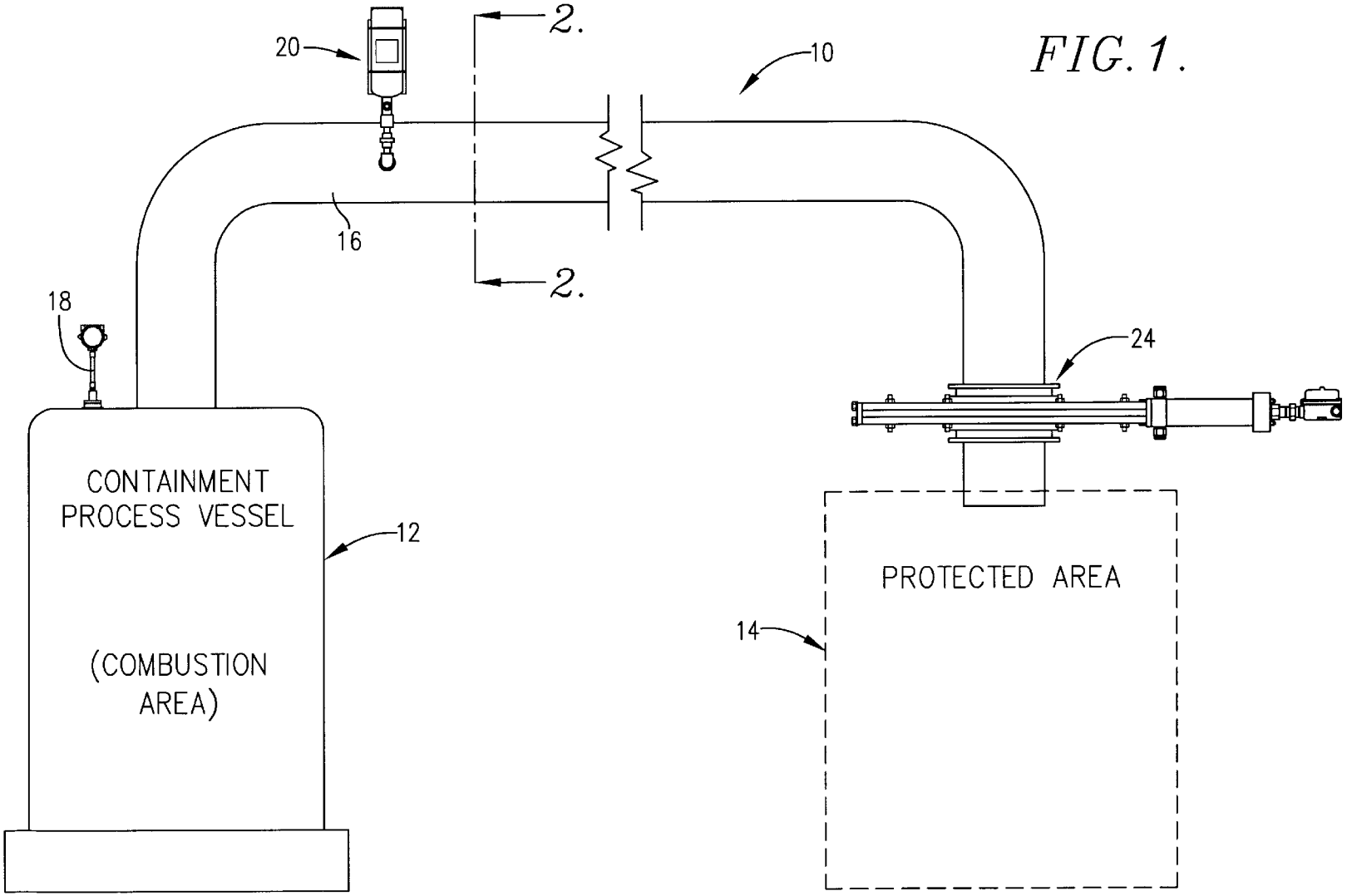
FIG. 1 is an essentially diagrammatic view of deflagration suppression and explosion isolation apparatus in accordance with the preferred embodiment of the invention and illustrating containment structure for a highly flammable, flowable material, a collection or processing area spaced from the structure, a conduit interconnecting the structure and the area, and a deflagration suppression device, and an explosion isolation assembly connected to the conduit.

A system 10 is shown essentially in diagrammatic form in FIG. 1 for containing highly combustible, flowable material, and for directing the material to or from a collection or processing area. In FIG.1, the material is shown as being contained in structure 12 identified as a containment process vessel. Structure 12 may vary according to a particular industrial application. For example, structure 12 may consist of a compartment in which metal grinding machines or other processing equipment are housed. Alternatively, structure 12 may take the form of a pressure vessel in which highly flammable, flowable material is stored. In particular, a typical containment vessel may be of steel, having a nominal thickness of the order of one inch where the combustible material is particularly hazardous, such as aluminum or magnesium fines, and have an interior volume of about five cubic meters.

A collection or processing areal 4 which receives the highly flammable material from structure is 12 is shown diagrammatically and labeled "PROTECTED AREA" in FIG. 1, and may comprise for example a conventional bag house collector, a cyclone-type collector, or structure for collection and then reprocessing of metal dust. A conduit 16 extends between and interconnects structure 12 and the protected area 14. Although the conduit 16 is shown diagrammatically as extending directly between structure 12 and protected area 14 with two 90° bends, it is to be understood that the depiction in FIG. 1 is for illustrative purposes only, and the actual longitudinal configuration of conduit 16 will vary from installation to installation, depending upon the distance between structure 12 and area 14, as well as the dictates of the plant layout. In typical industrial applications of the deflagration suppression and explosion isolation apparatus of this invention, conduit 16 generally will be a relatively large diameter type of the order of 12 to 24 inches in diameter and will have multiple bends. A 16-inch diameter pipe is often used for this purpose.

A pressure detector 18 mounted on structure 12 is mounted on and monitors the pressure inside of vessel structure 12. Detector 18 is operable to detect a rise in pressure within the structure 12 indicative of an incipient explosion. The detector 18 is connected to a controller (not shown) which, upon receipt of a signal from detector 18, is operable to send electrical activation signals to deflagration devices 20 and 22 mounted on conduit 16 in adjacent relationship to structure 12. The controller which is sensitive to detection of a pressure rise in structure 12 indicative of an incipient explosion, also sends electrical actuating signals to the explosion isolation gate valve assembly 24 also mounted on conduit 16. Although a preferred embodiment of the invention utilizes a pressure detector 18 which is operable to detect a rise in pressure within structure 12, it is to be understood that other types of conventional detectors may be employed to detect the onset of an incipient explosion.

Figures 2, 3, 4, 5:
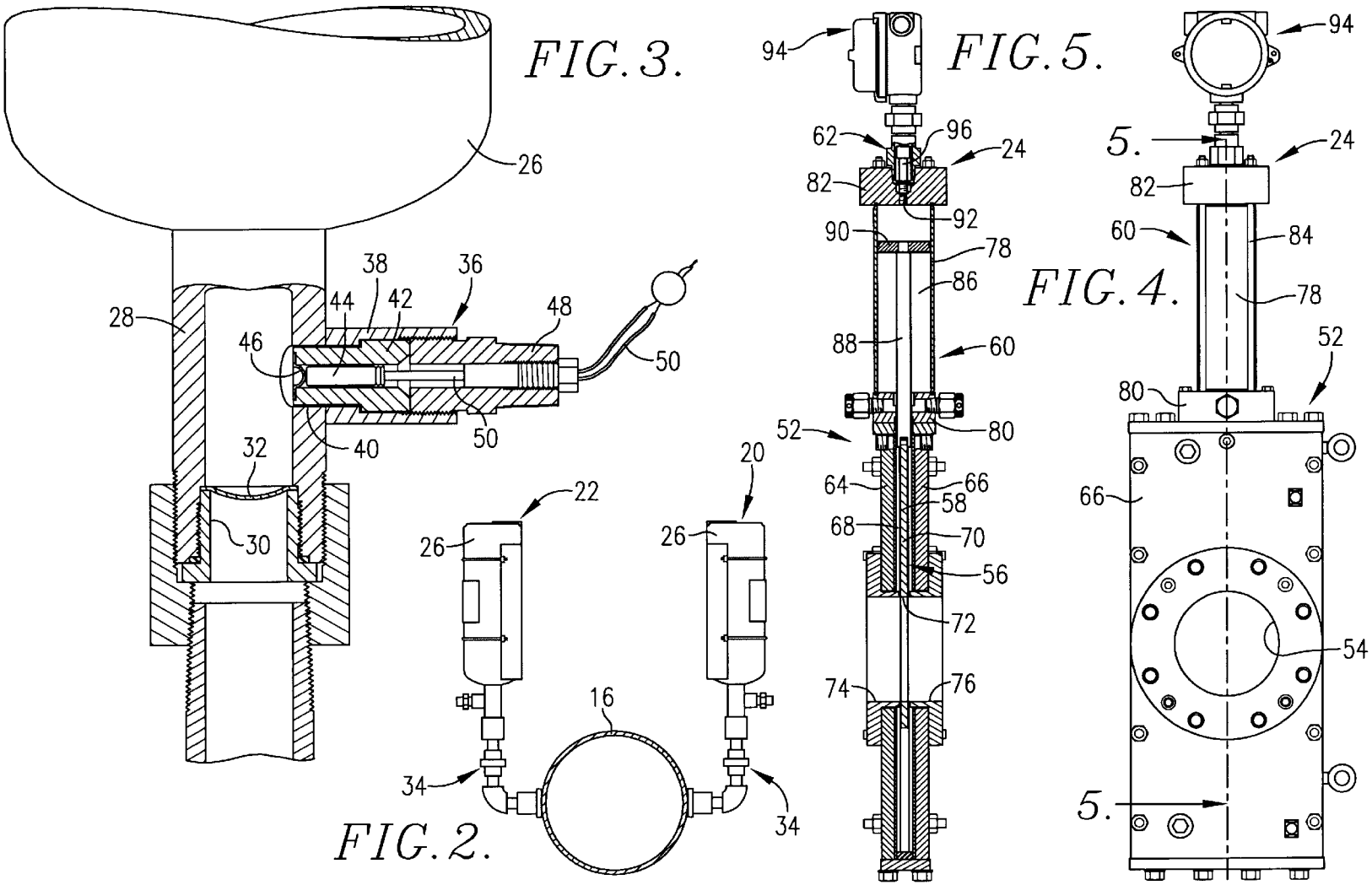
FIG. 2 is a cross-sectional view taken substantially on the line 2—2 of FIG. 1, looking in the direction of the arrows.
FIG. 3 is a fragmentary, enlarged, partial cross-sectional view of one of the suppressant agent delivery devices illustrated in FIG. 2.
FIG. 4 is a side view of the products of combustion isolation assembly depicted in FIG. 1.
FIG. 5 is a cross-sectional view along the lines 5—5 of FIG. 4, looking in the direction of the arrows.

Viewing FIG. 2, it can be seen that each of the devices 20 and 22 include a suppressant storage vessel 26 for containing a quantity of a dry suppressant agent in powdered form, such as sodium bicarbonate. A cylindrical end extension 28 integral with vessel 26 and communicating with the interior thereof is internally threaded at the outermost end thereof for removably receiving a flanged, externally threaded tubular fitting 30. A prebulged, domed rupture disc 32 is trapped between the innermost end of fitting 30 and an internal circular shoulder of extension 28 for normally closing the passage defined by end extension 28. It can be seen from FIG. 3 that disc 32 is preferably oriented such that the concave surface thereof faces the interior of pressure vessel 26.

Extension 28 of each of the storage vessels 26 is connected to and communicates with the interior of conduit 16 on opposite sides thereof. As is evident from FIG. 2, the connection between each vessel 26 of devices 20 and 22 and respective opposite sides of conduit 16 takes the form of conventional piping 34 of overall L-shaped configuration. A quantity of a pressurized gas such as nitrogen is provided in each of the vessels 26 for forcing the solid suppressant agent out of a corresponding vessel 26 upon rupture of a respective disc 32.

Although a detonator may be used to release suppressant from a bottle containing suppressant agent that is maintained under pressurized nitrogen, a preferred construction comprises a gas cartridge unit 36 mounted on the extension 28 of each of the vessels 26 in direct communication with the interior of a respective extension. To that end, extension 28 of each vessel 26 has a tubular element 38 affixed to the outer side wall thereof and which is in alignment with an opening 40 in the side wall of a respective extension 28. A sleeve 42 is carried within each tubular element 38 and supports a gas-generating cartridge 44 which rests against a prebugled rupture disc 46 normally closing the interior passage through sleeve 42. The cartridge 44 may contain a gas-generating propellant formulation that, for example, may comprise a combination of potassium perchlorate, nitroglycerine, nitrocellulose, and lead thiocyanate, having a minimum auto-ignition temperature of about 325EF and a DOT classification of 1.4s and a UN classification of 0323. The quantity of smokeless powder contained within cartridge 44 should be adequate to generate gaseous products of combustion to rupture disc 46 as well as disc 32. A tubular end closure 48 is threaded into extension 38 of each of the devices 20 and 22, and serves to lock cartridge 44 in place. Electrical wires 50 are connected to the cartridge unit 44 and to the controller which receives an actuating signal from detector 18.

The explosion isolation gate valve assembly 24 mounted on conduit 16 and which is shown in greater detail in FIGS. 4 and 5, may be of the type illustrated and described in application Ser. No. 09/373,087 filed Aug. 12, 1999, assigned to the Assignee hereof, and entitled "Gas Cartridge Actuated Isolation Valve," now U.S. Pat. No. 6,131,594, which is incorporated herein by specific reference thereto. As illustrated and described in the '087 application '594 patent], gate valve assembly 24 is also of a type actuated by a gas cartridge unit.

Gate valve assembly 24 includes a valve body 52 presenting a flow passageway 54 aligned with conduit 16. A gate unit 56 forming a part of valve body 52 has a shiftable, apertured, plate-type gate member 58. An actuator 60 forms a part of the assembly 24, and includes a gas-generating cartridge or unit 62 which is the same type as gas-generating unit 36.

The valve body 52 includes a pair of upright, spaced apart, interference plates 64, 66 cooperatively defining an upright internal chamber 68. The gate unit 56 includes an elongated, upright, metallic gate member or plate 70 which is situated within the chamber 68 and is designed for up and down shifting movement therein. As shown, the plate 70 has a circular aperture 72 therethrough which is of the same size as plate openings 74 and 76 in body plates 64 and 66 respectively. As those skilled in the art will appreciate the gate member 70 is shiftable between a valve open position as shown in FIG. 5, wherein the aperture 72 is in registry with openings 74 and 76, and a valve closed position, wherein the gate member 70 is shifted downwardly so that the aperture 72 is fully out of register with openings 74 and 76, thus blocking flow through conduit 16 at the position of the assembly 24.

The actuator 60 includes an upright, tubular piston cylinder 78 having a base 80 provided with a vertical through-bore, as well as an annular top fixture 82. The base 80 is secured to plates 64 and 66, whereas the top fixture 82, surmounting the upper end of cylinder 78, is attached to the base 80 by means of long shank connectors 84. The top fixture 82 has a threaded bore for receiving cartridge unit 62. The cylinder 78, base 80 and top fixture 82 cooperatively define an internal piston chamber 86. An elongated piston rod 88 is secured to the upper end of gate member 70 and extends into chamber 86. A circular piston 90 is secured to the uppermost end of rod 88 is slidable within the chamber 86.

The gas-generating cartridge unit 62 may be identical to gas cartridge unit 36, and is threadably connected to top fixture 82 in communication with the chamber 86 via passage 92 in fixture 82. The unit 62 has a gas cartridge 96 which is the same as cartridge 36 in that the smokeless powder formulation is as previously described with respect to cartridge 36, with the understanding that a sufficient quantity of the powder is provided to actuate and shift gate member 70 in accordance with the operating parameters specified herein. Unit 62 also has a prebulged rupture disc identical to disc 46. Housing 94 connected to the outer ends of gas cartridge unit 62 contains electrical controller components which are operably coupled directly to the detector 18 or, alternatively, to the controller previously described that is actuated by detector 18.

Normally, the particulate or gaseous material contained in structure 12, whether it be a compartment or pressure vessel as previously described, is directed into area 14 via conduit 16 as a result of operation of a blower which provides positive pressure to the interior of structure 12, or a negative pressure inside of structure 12 by virtue of the blower being located within area 14. Solid particulate material, such as aluminum or magnesium fines, when received in area 14 is either collected by suitable conventional bag structure, or a cyclone, or is directed to equipment for processing of the metal particles. On the other hand, a gaseous product, such as hydrogen, may either be exhausted, or collected for use. Alternatively, the flow of particulate and/or gaseous material may flow from area 12 toward structure 12 presenting a similar hazard.

However, if the detector 18 detects a rise in the pressure within structure 12 indicative of ignition of the combustible material contained in structure 12. The incipient explosion detected by detector 18 triggers operation of the devices 20 and 22 as well as the gate valve assembly 24. In the case of the suppression of the deflagration suppression devices 20 and 22, the electrical signal generated as a result of detection of a pressure rise within structure 12 by detector 18, and which derives from the controller which is connected to or is a part of detector 18, is directed to each of the gas cartridges 44, thus effecting actuation of each of the cartridges. Pressurized gas generated by the cartridges 44 in each of the gas cartridge units 36 causes rupture of respective rupture disc 46 thus permitting the gaseous products from cartridge 44 to enter the interior of end extension 28. The gas pressure from cartridge 44 also functions to immediately rupture disc 32.

Rupture of disc 32 allows the nitrogen in each of the suppressant storage vessels 26 of both of the devices 20 and 22 to force the dry powder suppressant stored therein through respective piping 34 directly into conduit 16 on opposite sides thereof. The devices 20 and 22 are preferably positioned along conduit 16 in sufficiently spaced relationship from containment structure 12 to result in release of the dry suppressant into conduit 16 on opposite sides thereof, just prior to arrival of the flame generated by ignition of the material in the containment structure 12 and which travels along conduit 16 from the pressure source in structure 12. A finite, although very short, period of time is required for the rise in pressure in containment structure 12 to be sensed by detector and for the detector to respond to a predetermined pressure, usually no more than about 1 to 2 to 10 m/s. Furthermore, a short time period, only a few milliseconds, is required for the gas cartridge 36 to be activated and for the rupture discs 46 and 32 respectively to be ruptured by gas pressure from cartridge 36. Finally, a short interval of time is required for the released suppressant agent to traverse respective pipes 34 and into opposite sides of the conduit 16. Accordingly, when locating suppressant devices 20 and 22, the sum of the respective time intervals for delivery of the suppressant agent into the interior of conduit 16 should be accounted for, given the speed at which the flame produced by ignition of the combustible material in containment structure 12 will be traveling along conduit 16 from containment structure 12 until it reaches the locale of suppressant agent delivery pipes 34 connected to conduit 16. The suppression devices will be located such that they will discharge prior to the arrival time of the flame front. Generally, this will be within the range of about 1 to 5 meters along the length of conduit 16 away from the point of connection of the conduit to containment structure 12.

The gas cartridge unit 62 of gate valve assembly 24 is also actuated at the same time of actuation of the gas cartridge unit 36. The powder in cartridge 96 is ignited, thus producing a pressurized gaseous discharge which is directed into the interior of cylinder 78 via passage 92. The gas pressure within cylinder 78 above piston 90 drives the piston downwardly as shown in FIG. 5 thereby exerting force on the piston rod 88 connected to the gate member 58. Shifting of piston 90 and the associated piston rod 88 causes the gate member 58 to be moved into full closing relationship to openings 74 and 76 thereby closing off flow of materials through conduit 16. As previously indicated, the amount of the gas generating charge in cartridge 96 should be adequate to cause the gate member 70 to be moved into full closing relationship to the passage through conduit 60, within a time interval of about 3 to 5 ms for each inch of diameter of conduit 16.

Accordingly, gate valve assembly 24 should be located in conduit 16 downstream of suppression devices 20 and 22 a distance such that the gate member 70 is fully closed before the pressure wave of the products of combustion produced by burning of the contained material in structure 12 and which is traveling along the length of conduit 16, reaches the vicinity of gate valve assembly 24. In the example above, the spacing between suppression devices 20 and 22 and gate valve assembly 24 will be in the range of about 5 to 10 meters.

Limitation of the pressure wave to a level of no more than about 12 to 13 bar in conduit 16, as opposed to the 30 bar level of the pressure wave experienced without suppression devices 20 and 22, allows the gate member 70 to fully close off conduit 16 and not allow flame and pressure from the incipient explosion of the material in containment structure 12 to enter the collection or processing area 14.

Thus, area 14 will be fully protected from an explosion that may have occurred in the containment structure 12. Without the provision of the suppression devices 20 and 22 which deliver suppressant agent into the conduit 16, the flame and pressure wave generated by ignition of highly flammable material such as aluminum or magnesium fines in containment structure 20 and traveling along the length of conduit 16 would be of such velocity and magnitude that the products of combustion would undergo a transition from a deflagration stage to a detonation stage. Therefore, the gate member 70 could not be placed such that it would close fully before the arrival of the detonation flame front. Furthermore, in the case of fires resulting from ignition of highly flammable materials such as aluminum, magnesium and hydrogen, as examples, the pressure wave from detonation of the material in conduit 16 would be of a sufficiently high level to cause limited physical displacement of the gate member 70 axially of conduit 16 and thereby allow leakage of flame and pressure past the seals of gate valve assembly 24 on each side of the gate member or plate 58.

It has been determined, for example, that upon ignition of confined aluminum particles the pressure wave will reach a level of at least about 30 bar in conduit 16 downstream of containment structure 12. By introducing the suppressant agent into conduit 16 ahead of, the time of arrival of the flame front at the piping 34 forming a part of each of the suppressant devices 20 and 22, it has further been determined that when the suppressant agent is supplied from a 9 liter explosion suppressant vessel containing sodium bicarbonate as the suppression media, the suppressant agent lowered the pressure wave to a level of no more than about 12 to 13 bar within conduit 16 beyond the suppressant devices 20 and 22.

We claim:

1. Deflagration suppression and explosion isolation apparatus comprising:

structure for confining flowable, combustible material which presents a fire and explosion hazard;

an elongated conduit communicating with the structure for normally conveying material from the structure to a defined area remote from the structure, said conduit being of a length and configuration longitudinally thereof that upon unforseen ignition of the material in the structure, flame can course along the conduit toward the defined area in the form of a deflagration front that transitions into a detonation state before reaching the defined area;

a suppressant device communicating with the conduit in disposition to direct a suppressant agent into the conduit;

a pressure detector associated with the structure and said conduit and operable to sense a rise in pressure resulting from ignition of the material in the structure and to activate the suppressant device to deliver suppressant agent into the conduit, said suppressant unit being located on the conduit along the length thereof in disposition to inject suppressant agent into the conduit at a point before the flame can reach the point of suppressant injection; and an isolation assembly connected to the conduit ahead of the protected area is operable in association with the suppressant device to activate a physical barrier to prevent flame and pressure from entering.

2. The apparatus as set forth in claim 1, wherein said suppressant device comprises a storage vessel for containing a quantity of the suppressant agent, and control components for rapidly releasing the suppressant agent for delivery into the conduit in response to sensing by the detector of ignition of combustible material in the structure.

3. The apparatus as set forth in claim 2, wherein said control components include a rupture disc located to block release of the suppressant agent from the storage vessel until after activation of the suppressant device by the detector.

4. The apparatus as set forth in claim 3, wherein said control components of the suppressant device include a gas-generating cartridge unit for rupturing the disc, said cartridge unit for rupturing the disc, said cartridge unit being operably coupled to the detector for activation by the latter to direct gases against the rupture disc with sufficient force to rupture the disc.

5. The apparatus as set forth in claim 4, wherein is provided a pressurized fluid in said suppressant agent storage vessel for forcibly ejecting the suppressant agent from the storage vessel upon controlled rupture of the rupture disc.

6. The apparatus as set forth in claim 1, wherein is provided a pair of said suppressant devices connected to the conduit on opposite sides of the conduit for substantially simultaneously delivering suppressant agent into the conduit from opposite sides thereof.

7. The apparatus as set forth in claim 1, wherein is provided a sufficient quantity of said suppressant agent to reduce the pressure of the products of combustion coursing through the conduit upon ignition of the material by at least about 50%.

8. The apparatus as set forth in claim 1, wherein said isolation assembly includes a gate valve having a slidable plate movable into blocking relationship to the conduit to prevent flame and pressure from entering the defined area through said conduit.

9. The apparatus as set forth in claim 8, wherein said isolation device includes a gas cartridge unit operably associated with the plate for shifting the latter, said gas cartridge and of the isolation assembly being activated in association with operation of the suppressant unit to deliver suppressant agent into the conduit.

10. The apparatus as set forth in claim 8, wherein is provided a piston and piston rod mechanism, the rod of said mechanism being connected to the plate of the gate valve and the piston being positioned to receive gases generated by the gas cartridge unit of the assembly upon activation of the unit to effect shifting of the piston and the rod to move the plate connected thereto into the blocking position thereof in the conduit.

11. The apparatus as set forth in claim 1, wherein said gas cartridge unit of the isolation assembly is operable to generate sufficient gas pressure against the piston to effect shifting of the rod and thereby the plate connected thereto at a rate no less than about 3 to 5 m/s per inch of the diameter of the conduit.

* * * * *